US005901579A

United States Patent [19]

Mahoney et al.

[11] Patent Number: 5,901,579

[45] Date of Patent: May 11, 1999

[54] CRYOGENIC AIR SEPARATION SYSTEM WITH INTEGRATED MACHINE COMPRESSION

[75] Inventors: Kevin William Mahoney, Amherst; Christine Barbara Allen-Hayes, East Aurora; Jack Michael Leo; Paul Arthur Henry, both of Williamsville; Todd Alan Skare, Elma; Dante Patrick Bonaquist, Grand Island; James Richard Handley, E. Amherst, all of N.Y.

[73] Assignee: Praxair Technology, Inc., Danbury, Conn.

[21] Appl. No.: 09/054,443

[22] Filed: Apr. 3, 1998

[51] Int. Cl.[6] ..... F25J 3/04

[52] U.S. Cl. ..... 62/646; 62/910

[58] Field of Search ..... 62/643, 646, 910

[56] References Cited

U.S. PATENT DOCUMENTS

| | | | |
|---|---|---|---|
| 3,731,495 | 5/1973 | Coveney | 62/643 |
| 4,133,662 | 1/1979 | Wagner . | |
| 4,817,393 | 4/1989 | Erickson . | |
| 5,098,456 | 3/1992 | Dray et al. . | |
| 5,222,365 | 6/1993 | Nenov | 62/643 |
| 5,228,298 | 7/1993 | Kun et al. | 62/910 X |
| 5,263,328 | 11/1993 | Rohde . | |
| 5,365,741 | 11/1994 | Roberts et al. . | |
| 5,386,692 | 2/1995 | Laforce . | |
| 5,460,003 | 10/1995 | Nenov | 62/910 X |
| 5,475,980 | 12/1995 | Grenier et al. | 62/646 |
| 5,628,207 | 5/1997 | Howard et al. | 62/646 |
| 5,655,388 | 8/1997 | Bonaquist et al. | 62/651 |
| 5,675,977 | 10/1997 | Prosser | 62/646 |
| 5,758,515 | 6/1998 | Howard | 62/646 |

FOREIGN PATENT DOCUMENTS

| | | |
|---|---|---|
| 672877 | 9/1995 | European Pat. Off. . |

*Primary Examiner*—Christopher B. Kilner
*Attorney, Agent, or Firm*—Stanley Ktorides

[57] ABSTRACT

A cryogenic air separation system wherein base load pressure energy is supplied to the feed air by a base load compressor and custom load pressure energy is supplied to the feed air by a bridge machine having one or more turbine booster compressors and one or more product boiler booster compressors, all of the compressors of the bridge machine driven by power supplied through a single gear case.

8 Claims, 2 Drawing Sheets

CRYOGENIC AIR SEPARATION SYSTEM WITH INTEGRATED MACHINE COMPRESSION

TECHNICAL FIELD

This invention relates generally to cryogenic air separation for the production of both gaseous product and liquid product and, more particularly, to a compression system for the provision of customized pressure energy to the cryogenic air separation plant enabling the plant to efficiently produce the product slate desired from the plant.

BACKGROUND ART

Modest amounts of cryogenic liquid product can be produced from an air separation plant by boosting a portion of the air stream from the main air compressor, cooling it, then expanding it through a lower column turbine. For an internal compression cycle, efficient, cost effective turndown of the liquid production from the design point cannot be achieved with conventional cycles and/or turbomachinery. A solution is needed to enable a plant that is designed for high liquid production to decrease its liquid product with an associated power savings. Also, a plant that is to be built in a developing market can be designed for the eventual high liquid production rate, but can run initially at an efficient, lower production rate until the market grows.

The problem stems from the nature of a pumped liquid oxygen cycle, specifically with regards to the product boiler compressor. A portion of the air stream from the main air compressor is compressed, cooled, then condensed in a product boiler to vaporize the high pressure liquid oxygen stream. At each plant, the delivery pressure of the gaseous oxygen stream is fixed. While this pressure can vary from 50 to 500 plus pounds per square inch gauge, it remains constant at each plant. This requires that the compressor used to supply the high pressure feed air, referred to as the product boiler compressor, must discharge at a constant pressure. It is this fixed discharge pressure requirement that limits the variability in liquid product. Once a centrifugal compressor is designed and operated for a given discharge pressure and flow, a reduction in the suction pressure is not possible. Any reduction in suction pressure results in a corresponding decrease in outlet pressure, which means that the gaseous oxygen pressure requirement of the plant would not be met.

While the gaseous oxygen pressure at a given plant must be held constant, it is desirable to be able to vary the liquid production from the plant. The boosting of the air stream for liquid production is accomplished by either a separate compressor or by a booster loaded by the work output of the turbine. A reduction in liquid product from the design point is achieved by decreasing the inlet pressure to the lower column turbine. If a separate compressor is used, this reduction in turbine inlet pressure is achieved by adjusting the outlet pressure of the machine by utilizing either guide-vanes or a suction throttle valve. This allows for a decrease in liquid product with an associated decrease in power, albeit at a slight cost penalty. The disadvantage to this alternative is that it is capital intensive in that it requires a separate compressor including motor, skid, lube oil system, etc. This is in addition to the same components being required for both the product boiler compressor and turbine.

The turbine loaded booster is a less expensive alternative, however there is no power savings associated with liquid turndown. Reducing the inlet pressure to the compressor will result in a lower outlet pressure and reduced liquid.

However, since the booster is loaded by the turbine, there is no electrical power reduction. Power savings could be achieved by lowering the inlet pressure to the booster via a reduction in the main air compressor discharge pressure. However, the discharge pressure of the main air compressor must remain constant for the product boiler compressor to be able to meet its requirement. Therefore, there are no power savings available with using a turbine loaded booster compressor for liquid production.

Another problem with conventional systems is the selection of the product boiler compressor itself. The product boiler compressor is used to elevate the air pressure to that level needed to boil the liquid oxygen in the product boiler. As discussed above with relation to the turbine booster, a separate compressor for this is cost prohibitive. To reduce costs, extra pinions may be added to the main air compressor, which allows the addition of one or more stages of product boiler compression onto the main air compressor. The disadvantage of this alternative is the difficulty in achieving good efficiencies from these product boiler wheels. This is because the speed of the bullgear is set to optimize the efficiency of the main compressor wheels, and this is typically not the best speed for the product boiler wheels.

In summary, the problem is that there is presently no system that allows varying of the liquid production, at constant product gaseous oxygen pressure, in a cost effective and efficient manner. For plants that are designed for liquid products above some minimal quantity, turndown of liquid production is very important. Not being able to reduce the liquid production detracts from the ability of the plant to respond to changing market conditions. When a plant is built, there may not be an immediate demand for large quantities of liquid. However, if the market demand increases, having a plant that can produce large quantities of liquid but can produce lesser quantities efficiently would be of high value.

Accordingly, it is an object of this invention to provide a cryogenic air separation system which can efficiently produce gaseous product, particularly at a defined elevated pressure, and also liquid product wherein the liquid production may change.

SUMMARY OF THE INVENTION

The above and other objects, which will become apparent to one skilled in the art upon a reading of this disclosure, are attained by the present invention, one aspect of which is:

A method for producing gaseous and liquid product from a cryogenic air separation plant comprising:

(A) compressing the total feed air for the cryogenic air separation plant to a base load pressure;

(B) dividing the base load feed air into a turbine booster fluid and a product boiler booster fluid;

(C) further compressing the turbine booster fluid by passage through at least one turbine booster compressor, and passing the turbine booster fluid into the cryogenic air separation plant;

(D) further compressing the product boiler booster fluid by passage through at least one product boiler booster compressor, passing the product boiler booster fluid through a product boiler, and passing the product boiler booster fluid into the cryogenic air separation plant;

(E) providing energy to operate all the turbine booster and all the product boiler booster compressors through a single gear case;

(F) separating the turbine booster fluid and the product boiler booster fluid in the cryogenic air separation plant by cryogenic rectification into gaseous product and liquid product; and (G) recovering both gaseous product and liquid product from the cryogenic air separation plant.

Another aspect of the invention is:

Apparatus for producing gaseous and liquid product from a cryogenic air separation plant comprising:

(A) a cryogenic air separation plant having at least one column;

(B) a base load air compressor and means for passing feed air to the base load air compressor;

(C) at least one turbine booster compressor and means for passing feed air from the base load air compressor to the turbine booster compressor(s);

(D) at least one product boiler booster compressor, a product boiler, means for passing feed air from the base load air compressor to the product boiler booster compressor(s) and from the product boiler booster compressor(s) to the product boiler;

(E) a gear case, means for drivingly coupling each turbine booster compressor to the gear case, and means for drivingly coupling each product boiler booster compressor to the gear case;

(F) means for passing feed air from the turbine booster compressor(s) into the cryogenic air separation plant, and means for passing feed air from the product boiler into the cryogenic air separation plant; and (G) means for recovering gaseous product from the cryogenic air separation plant and means for recovering liquid product from the cryogenic air separation plant.

As used herein, the term "feed air" means a mixture comprising primarily oxygen, nitrogen and argon, such as ambient air.

As used herein, the term "column" means a distillation or fractionation column or zone, i.e. a contacting column or zone, wherein liquid and vapor phases are countercurrently contacted to effect separation of a fluid mixture, as, for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column", is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the terms "turboexpansion" and "turboexpander" mean respectfully method and apparatus for the flow of high pressure gas through an axial or radial turbine to reduce the pressure and the temperature of the gas thereby generating refrigeration.

As used herein, the term "compressor" means a device for increasing the pressure of a gas.

As used herein, the term "product boiler" means a heat exchanger wherein liquid from a cryogenic air separation plant, typically at increased pressure, is vaporized by indirect heat exchange with feed air. A product boiler may be a standalone unit or may be incorporated into the heat exchanger used to cool the feed air.

As used herein, the term "turbine booster compressor" means a compressor, typically a rotary impeller unit, used to increase the pressure of the gas, usually a fraction of the feed air, used to develop process refrigeration. The gas is turboexpanded to produce the refrigeration.

As used herein, the term "product boiler booster compressor" means a compressor, typically a rotary impeller unit, used to increase the pressure of the gas, usually a fraction of the feed air, used to vaporize liquid to provide gas product. The liquid is generally pressurized so that the vaporized gas is available at an increased pressure level.

As used herein, the term "gear case" means a device used to transmit shaft energy between energy providers, i.e. electric motors, steam turbines and gas expanders, and energy users, i.e. gas compressors, electric generators. The gear case is an integral combination of individual gears and gears with associated shafts, that allows the provision of the optimum shaft speed for each energy unit.

Figure 1:
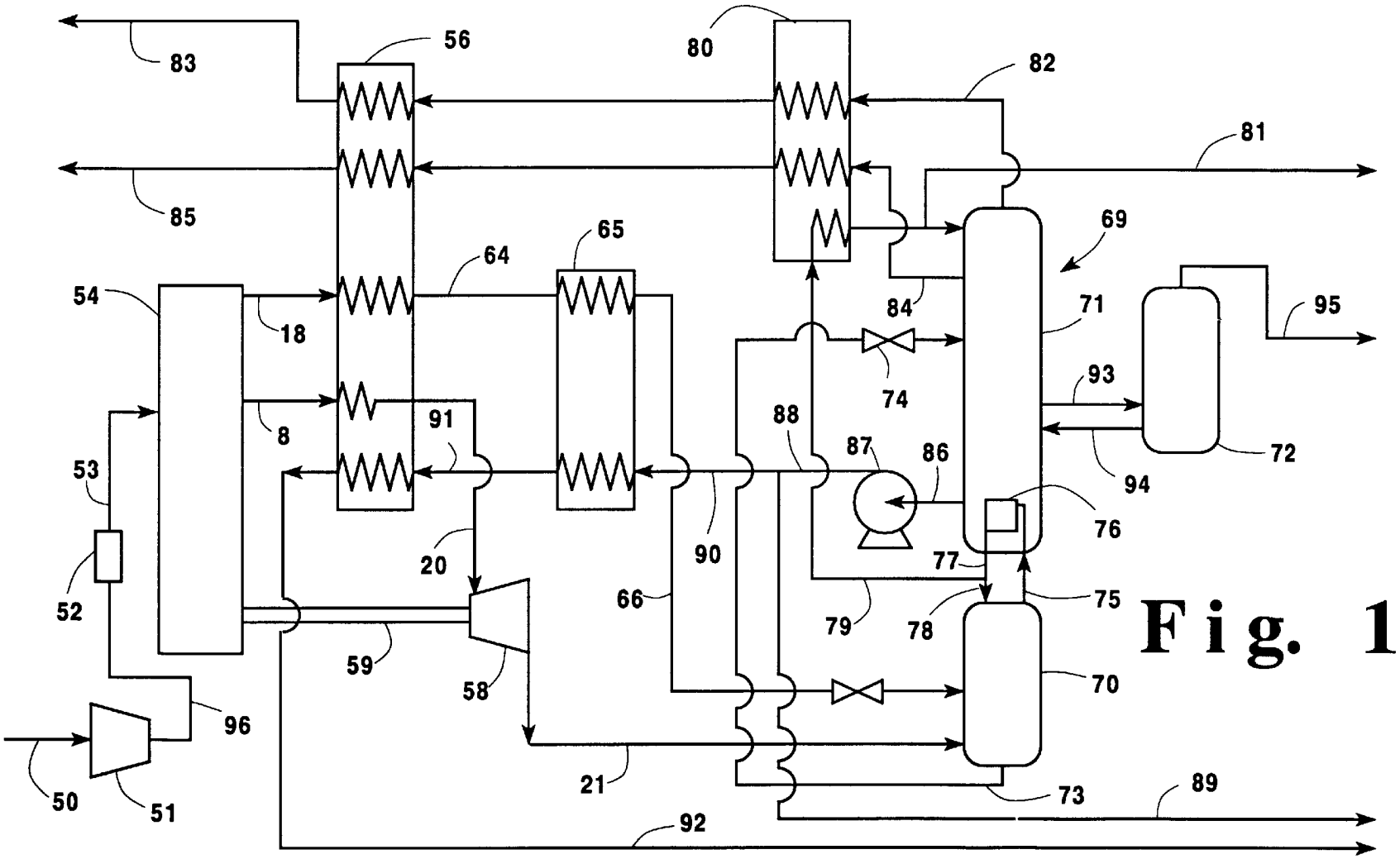
FIG. 1 is a simplified schematic representation of one preferred embodiment of the cryogenic air separation system of this invention.

The numerals in the drawings are the same for the common elements.

DETAILED DESCRIPTION

The invention will be described in detail with reference to the Drawings. Referring now to both FIGS. 1 and 2, the total feed air which is to be supplied to the cryogenic air separation plant, represented by feed air stream 50, is passed into base load air compressor 51 wherein it is compressed to a base load pressure, generally within the range of from 140 to 180 pounds per square inch absolute (psia). The base load pressure provides sufficient energy to the cryogenic air separation plant to enable separation of the feed air into one or more of product oxygen, nitrogen and argon, to produce the gaseous products at nominal pressure, and to produce a nominal amount of liquid product, typically about 2 percent of the feed air. The base load pressure feed air 96 is then cleaned of high boiling impurities, such as water vapor, carbon dioxide and hydrocarbons, by passage through prepurifier 52 and the cleaned base load pressure feed air 53 is supplied to bridge machine 54 which is shown in block form in FIG. 1 and in detail in FIG. 2.

The bridge machine provides customized pressure energy to the cryogenic air separation plant in an efficient manner to enable one or more gaseous products to be recovered at supernominal elevated pressure, and also to enable liquid production in supernominal amounts. Moreover, the bridge machine enables variation in this custom product slate for the plant without encountering an efficiency penalty. The bridge machine arrangement will be described in detail with reference to FIG. 2.

Figure 2:
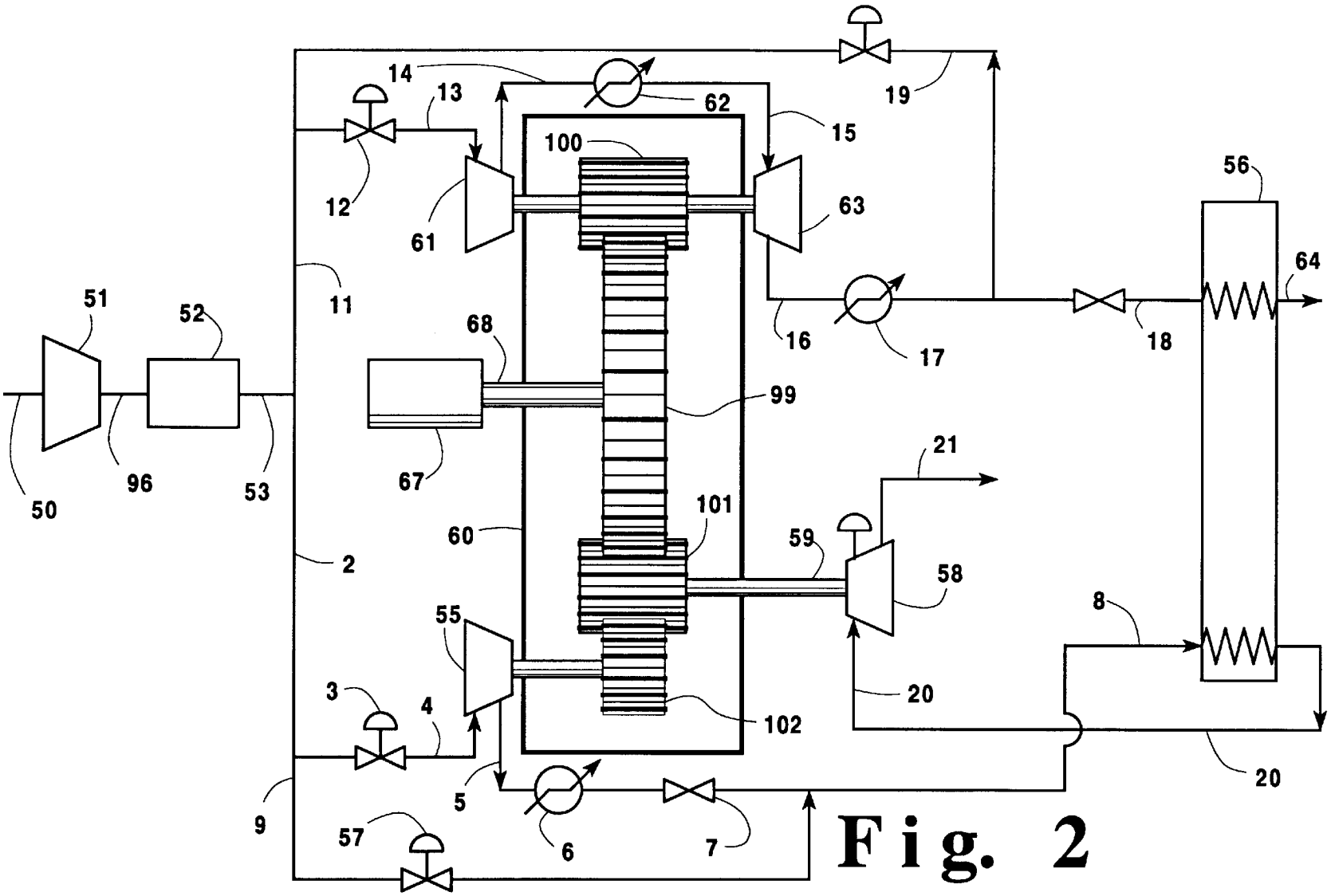
FIG. 2 is a more detailed representation of one embodiment of the bridge machine useful in the practice of this invention and its integration into a cryogenic air separation system.

Referring now to FIG. 2, base load pressure feed air 53 is divided into turbine booster fluid stream or fraction 2 and product boiler booster fluid stream or fraction 11. If desired, one or more other fractions of the base load pressure feed air may be passed to the cryogenic air separation plant, either with or without undergoing further compression. If such other fraction is further compressed, preferably the compressor is powered by energy delivered through gear case 60. Turbine booster fluid is passed through suction throttle or inlet guidevane 3 and, as stream 4, into turbine booster compressor 55. Within turbine booster compressor 55 the turbine booster fluid is compressed to a pressure generally within the range of from 250 to 350 psia. Resulting turbine booster fluid 5 is cooled of the heat of compression, such as by passage through cooler 6, and then passed through valve 7 to primary heat exchanger 56 in stream 8. If desired, some or all of turbine booster fluid 2 may bypass turbine booster 55 in stream 9 through valve 57.

The turbine booster fluid in stream 8 is cooled by passage through primary heat exchanger 56 and then passed into the cryogenic air separation plant. In the embodiment of the invention illustrated in the Drawings, the cooled turbine booster fluid 20 is passed through turboexpander 58 wherein it is turboexpanded, with the resulting turboexpanded turbine booster fluid 21 then passed into the cryogenic air separation plant. Turboexpander 58 has a shaft 59 which engages gear case 60 of bridge machine 54 providing at least some of the energy to drive the bridge machine.

Product boiler booster fluid in stream 11 is passed through suction throttle or inlet guidevane 12 and as stream 13 into first product boiler booster compressor 61 wherein it is compressed. The compressed fluid 14 is cooled of the heat of compression, such as by passage through cooler 62, and then passed as stream 15 into second product boiler booster compressor 63 wherein it is further compressed. The resulting product boiler booster fluid 16, generally at a pressure within the range of from 200 to 550 psia, is cooled of the heat of compression, such as by passage through cooler 17, and as stream 18 is passed into and through primary heat exchanger 56 wherein it is cooled by indirect heat exchange with return streams. If desired, a portion 19 of stream 18 may be recycled to the product boiler booster compressors as shown in FIG. 2. The resulting turbine booster fluid 64 is then passed to product boiler 65 wherein it is cooled and generally at least partially condensed while serving to boil elevated pressure liquid from the cryogenic air separation plant. The resulting product boiler booster fluid 66 is then passed into the cryogenic air separation plant.

The bridge machine is driven by a motor/generator or other prime mover 67 which supplies power to gear case 60 through shaft 68. Depending on the net energy balance between all the units on the bridge machine, motor/generator 67 could extract power. All of the turbine booster compressors and all of the product boiler booster compressors are drivingly coupled to this single gear case by appropriate shafts so as to communicate force or power.

The gear case 60 contains all the interconnected gears necessary to transmit the shaft energy associated with all the individual compressors, expanders and electric motors of the bridge machine. Typically the bridge machine will include a primary gear 99, or bull gear, that is shaft connected to the major prime mover, such as electric motor 67. Additional secondary gears, or pinions, 100, 101, 102 are used to connect individual or paired units to the bull gear. Further, other intermediate gears (not shown) can be used between the bull gear and pinions to modify the gear ratio or rotational speed for individual attached units. The geometrical relationship of the gear diameters and teeth provide for translating the rotating speed of adjoining gears in inverse relationship to their gear diameters.

The major advantage of the common gear case of the invention is the ability to provide optimum rotational speed for each attached expander or compressor. For example, with the use of the common gear case, an expander is not limited to operation at the same speed as a compressor connected to the same shaft. Furthermore, the use of the single gear case avoids the constraints of the expander and the compressor energy requirements. Therefore, all the compressor and expander stages can be designed for their optimum speed, pressure ratio and flow to satisfy process flexibility and turbomachinery design criteria. Also, a single gear case minimizes mechanical losses, i.e. friction of bearings and gears, and reduces installation costs. The unitary and compact package reduces piping losses and can allow shop rather than field installation.

Any suitable cryogenic air separation plant may be used in the practice of this invention. FIG. 1 illustrates one such plant 69 which comprises a double column having higher pressure column 70 and lower pressure column 71. The plant also has argon sidearm column 72.

Referring now to FIG. 1, turbine booster fluid 21 and product boiler booster fluid 66 are each passed into higher pressure column 70 which is operating at a pressure generally within the range of from 75 to 300 psia. preferably from 75 to 150 psia. Within higher pressure column 70 the fluids are separated by cryogenic rectification into oxygen-enriched liquid and nitrogen-enriched vapor. The oxygen-enriched liquid is passed in stream 73 from the lower portion of column 70 through valve 74 and into lower pressure column 71. Nitrogen-enriched vapor is passed from the upper portion of column 70 in stream 75 into main condenser 76 wherein it is condensed by indirect heat exchange with boiling column 71 bottom liquid. The resulting nitrogen-enriched liquid 77 is divided into stream 78, which is returned to column 70 as reflux, and into stream 79, which is passed through superheater 80 and into column 71. A portion 81 of nitrogen-enriched liquid 79 is recovered as product liquid nitrogen.

Lower pressure column 71 is operating at a pressure less than that of higher pressure column 70 and generally within the range of from 15 to 20 psia. Within lower pressure column 71 the various feeds are separated by cryogenic rectification into nitrogen-rich fluid and oxygen-rich fluid. Nitrogen-rich fluid is withdrawn from the upper portion of column 71 in vapor stream 82, warmed by passage through superheater 80 and primary heat exchanger 56, and recovered as gaseous nitrogen product in stream 83. For product purity control purposes a waste stream 84 is withdrawn from column 71 from a level below the withdrawal point of stream 82, warmed by passage through superheater 80 and primary heat exchanger 56, and removed from the system in stream 85.

Oxygen-rich fluid is withdrawn from the lower portion of column 71 in liquid stream 86 and pumped to an elevated pressure by passage through liquid pump 87 to produce elevated pressure oxygen-rich liquid 88. A portion 89 of oxygen-rich liquid 88 is recovered as product liquid oxygen. The remaining oxygen-rich liquid 90 is passed to product boiler 65 wherein it is vaporized by indirect heat exchange with product boiler booster fluid to produce elevated pressure gaseous oxygen 91. The elevated pressure gaseous oxygen 91 is warmed by passage through primary heat exchanger 56 and recovered in stream 92 as high pressure gaseous oxygen product.

A stream 93 comprising primarily oxygen and argon is passed from lower pressure column 71 into argon sidearm column 72 wherein it is separated by cryogenic rectification into argon-richer fluid and oxygen-richer fluid. The oxygen-richer fluid is returned to lower pressure column 71 in stream 94. The argon-richer fluid is recovered as product argon 95 which may be in liquid and/or gaseous form.

Although the invention has been described in detail with reference to a certain preferred embodiment, those skilled in the art will recognize that there are other embodiments of the invention within the spirit and the scope of the claims. For example, any effective means for providing power to operate the gear case, in addition to or in place of those illustrated in the Drawings, may be employed. One such power provision means is a stream driven turbine which drives a shaft coupled to the gear system. If desired, compression of recirculating fluid, as used in a heat pumping circuit, can be carried out using a compressor powered by energy delivered through gear case 60.

We claim:

1. A method for producing gaseous and liquid product from a cryogenic air separation plant comprising:

(A) compressing the total feed air for the cryogenic air separation plant to a base load pressure;

(B) dividing the base load feed air into a turbine booster fluid and a product boiler booster fluid;

(C) further compressing the turbine booster fluid by passage through at least one turbine booster compressor, and passing the turbine booster fluid into the cryogenic air separation plant;

(D) further compressing the product boiler booster fluid by passage through at least one product boiler booster compressor, passing the product boiler booster fluid through a product boiler, and passing the product boiler booster fluid into the cryogenic air separation plant;

(E) providing energy to operate all the turbine booster and all the product boiler booster compressors through a single gear case;

(F) separating the turbine booster fluid and the product boiler booster fluid in the cryogenic air separation plant by cryogenic rectification into gaseous product and liquid product; and (G) recovering both gaseous product and liquid product from the cryogenic air separation plant.

2. The method of claim 1 wherein power is provided to the gear case by a motor.

3. The method of claim 1 wherein power is provided to the gear case by a turboexpander.

4. The method of claim 3 wherein the turbine booster fluid is turboexpanded through the turboexpander prior to being passed into the cryogenic air separation plant.

5. Apparatus for producing gaseous and liquid product from a cryogenic air separation plant comprising:

(A) a cryogenic air separation plant having at least one column;

(B) a base load air compressor and means for passing feed air to the base load air compressor;

(C) at least one turbine booster compressor and means for passing feed air from the base load air compressor to the turbine booster compressor(s);

(D) at least one product boiler booster compressor, a product boiler, means for passing feed air from the base load air compressor to the product boiler booster compressor(s) and from the product boiler booster compressor(s) to the product boiler;

(E) a gear case, means for drivingly coupling each turbine booster compressor to the gear case, and means for drivingly coupling each product boiler booster compressor to the gear case;

(F) means for passing feed air from the turbine booster compressor(s) into the cryogenic air separation plant, and means for passing feed air from the product boiler into the cryogenic air separation plant; and (G) means for recovering gaseous product from the cryogenic air separation plant and means for recovering liquid product from the cryogenic air separation plant.

6. The apparatus of claim 5 further comprising a motor and means for drivingly coupling the motor to the gear case.

7. The apparatus of claim 5 further comprising a turboexpander and means for drivingly coupling the turboexpander to the gear case.

8. The apparatus of claim 7 wherein the means for passing feed air from the turbine booster compressor(s) into the cryogenic air separation plant includes the turboexpander.

* * * * *